US009180496B2

(12) United States Patent
Crocker

(10) Patent No.: US 9,180,496 B2
(45) Date of Patent: Nov. 10, 2015

(54) WATER BLASTING HEAD WITH THROUGH FEEDING HYDRAULIC MOTOR

(75) Inventor: James P. Crocker, Stuart, FL (US)

(73) Assignee: Waterblasting, LLC, Stuart, FL (US)

( * ) Notice: Subject to any disclaimer, the term of this patent is extended or adjusted under 35 U.S.C. 154(b) by 867 days.

(21) Appl. No.: 12/395,302

(22) Filed: Feb. 27, 2009

(65) Prior Publication Data

US 2009/0242003 A1 Oct. 1, 2009

Related U.S. Application Data

(60) Provisional application No. 61/032,286, filed on Feb. 28, 2008.

(51) Int. Cl.
*B08B 3/12* (2006.01)
*B08B 3/02* (2006.01)

(52) U.S. Cl.
CPC ..... *B08B 3/026* (2013.01)

(58) Field of Classification Search
CPC ..... B08B 3/026; E01H 1/00; E01H 1/10; E01H 1/101
USPC ..... 134/172, 198
See application file for complete search history.

(56) References Cited

U.S. PATENT DOCUMENTS 2,074,623 A 3/1937 Schroth
2,797,964 A * 7/1957 Alexander ..... 239/263
3,043,200 A 7/1962 Huttash
3,151,348 A 10/1964 Maasberg
3,166,773 A 1/1965 Wyczalek
3,407,005 A 10/1968 Simms et al.
3,532,070 A 10/1970 Lamarque
3,540,073 A 11/1970 Issenmann et al.
3,619,632 A 11/1971 Labombarde
3,639,936 A 2/1972 Ashton
3,658,589 A 4/1972 Shaddock
3,694,033 A 9/1972 Rowley et al.
3,774,873 A 11/1973 Krogsrud
3,787,916 A 1/1974 Akagi et al.
3,812,379 A 5/1974 Kaufman et al.
3,900,969 A 8/1975 Diehn
3,959,010 A 5/1976 Thompson et al.
3,977,128 A 8/1976 Goff
4,007,026 A 2/1977 Groh
4,158,575 A 6/1979 Townsend
4,199,837 A 4/1980 Fisco, Jr.
4,227,893 A 10/1980 Shaddock
4,241,803 A 12/1980 Lauber
4,290,820 A 9/1981 Swisher, Jr. et al.
4,336,671 A 6/1982 Nelson
4,376,358 A 3/1983 Shelton
4,377,924 A 3/1983 Bergh
4,509,963 A 4/1985 Jackson
4,578,840 A 4/1986 Pausch
4,683,684 A 8/1987 Yie
(Continued)

*Primary Examiner* — David Cormier
(74) *Attorney, Agent, or Firm* — McHale & Slavin, P.A.

(57) ABSTRACT

Briefly, disclosed is an ultra high pressure blasting head for a mobile marking removal system. The blasting head includes a hydraulic motor that is constructed and arranged for direct connection to a spray bar for controlled rotation thereof. The output shaft of the hydraulic motor is constructed to be hollow or tubular so that the ultra high pressure water can be supplied to the spray bar through the output shaft. The spray head assembly is particularly suited for mobile systems utilized to remove markings and/or coatings from surfaces with high or ultra high pressure liquid.

9 Claims, 17 Drawing Sheets

(56) References Cited

U.S. PATENT DOCUMENTS

| | | | | | |
|---|---|---|---|---|---|
| 4,753,052 | A | | 6/1988 | Dickson | |
| 4,793,734 | A | | 12/1988 | Shook et al. | |
| 4,806,172 | A | * | 2/1989 | Adaci et al. | 134/34 |
| 4,819,676 | A | | 4/1989 | Blehert et al. | |
| 4,839,061 | A | | 6/1989 | Manchak Jr. et al. | |
| 4,854,770 | A | | 8/1989 | Puchala et al. | |
| 4,935,984 | A | | 6/1990 | Bryant et al. | |
| 5,002,595 | A | | 3/1991 | Kehr | |
| 5,022,809 | A | | 6/1991 | Hinson | |
| 5,076,919 | A | | 12/1991 | Francisco, Jr. | |
| 5,078,161 | A | * | 1/1992 | Raghavan et al. | 134/16 |
| 5,082,065 | A | | 1/1992 | Fletcher | |
| 5,108,471 | A | | 4/1992 | Poborsky | |
| 5,224,236 | A | | 7/1993 | Sallquist | |
| 5,236,278 | A | | 8/1993 | Dickson | |
| 5,433,381 | A | * | 7/1995 | Stenzel et al. | 239/263 |
| 5,589,080 | A | | 12/1996 | Cho et al. | |
| 5,600,995 | A | | 2/1997 | Sherman | |
| 5,605,381 | A | | 2/1997 | Schmoock, Jr. et al. | |
| 5,625,967 | A | | 5/1997 | Kulle | |
| H1660 | H | | 7/1997 | Herman et al. | |
| 5,704,989 | A | | 1/1998 | Page | |
| 5,826,460 | A | | 10/1998 | Soncina et al. | |
| 6,082,630 | A | | 7/2000 | Bohrer | |
| 6,129,094 | A | | 10/2000 | Moll et al. | |
| 6,152,674 | A | | 11/2000 | Ogrodnick | |
| 6,224,317 | B1 | | 5/2001 | Kann et al. | |
| 6,302,967 | B1 | | 10/2001 | Rohrbacher et al. | |
| 6,393,944 | B1 | | 5/2002 | Soncina et al. | |
| 6,896,742 | B2 | | 5/2005 | Geyer et al. | |
| 7,255,116 | B2 | | 8/2007 | Crocker | |
| 2001/0042558 | A1 | | 11/2001 | Rohrbacher et al. | |
| 2002/0178529 | A1 | | 12/2002 | Geyer et al. | |
| 2003/0205242 | A1 | | 11/2003 | Gerber et al. | |
| 2004/0070172 | A1 | | 4/2004 | Colistro | |
| 2004/0237247 | A1 | | 12/2004 | Nowak et al. | |
| 2006/0000491 | A1 | | 1/2006 | Crocker | |
| 2006/0185689 | A1 | | 8/2006 | Crocker | |
| 2007/0169797 | A1 | | 7/2007 | Crocker | |
| 2007/0204889 | A1 | | 9/2007 | Crocker | |
| 2007/0207711 | A1 | | 9/2007 | Crocker | |
| 2008/0066781 | A1 | | 3/2008 | Crocker | |

* cited by examiner

| ITEM NO. | PART NUMBER | DESCRIPTION | QTY. |
|---|---|---|---|
| 1 | - | CASAPPA MOTOR BODY | 1 |
| 2 | - | CASAPPA BOTTOM FLANGE | 1 |
| 3 | - | CASAPPA TOP FLANGE | 1 |
| 4 | CS1000-151-TEMP | FLANGE BLOCK | 1 |
| 5 | CS1000-152 | HOUSING | 1 |
| 6 | CS1000-153 | HOUSING COVER | 1 |
| 7 | MP1006A | SHIELD, DIRT | 1 |
| 8 | CS1000-5H1-TEMP | SHAFT | 1 |
| 9 | CS1000-5H2 | SWIVEL SHAFT | 1 |
| 10 | CS1000-5H3 | GLAND NUT | 1 |
| 11 | CS1000-5N1 | NUT | 1 |
| 12 | CS1000-15N3 | NUT DISC | 1 |
| 13 | CS1000-15N4 | NUT DISC WASHER | 1 |
| 14 | MP4000-CBL-1410 | CASTER PLATE 10in WHEELS | 1 |
| 15 | SM9001-14 | SHROUD 14in | 1 |
| 16 | 315207ADI-NITRILE | SEAL 31x52x7mm | 1 |
| 17 | 203800ADI-NITRILE | SEAL 20x38x5mm | 1 |
| 18 | 7304WN | Angular contact ball bearings 20x52x15 (Medium 7300wn Series) | 1 |
| 19 | 8R1001 | SEAL, UPPER SWIVEL SHAFT | 1 |
| 20 | MP1004-FG | FELT GASKET | 1 |
| 21 | 9394K21-Oring | O-RING 1 | 1 |
| 22 | 9396K113-Oring | O-RING 2 | 1 |
| 23 | 283807ADI-VITON | SEAL 28x38x7mm | 1 |
| 24 | MP1020-1430 JET SPRAY BAR | 14" SPRAY BAR 30 JET | 1 |
| 25 | MP1008 | SEAL BRASS BUTTON | 1 |
| 26 | SKF - 6304 - Full DENC/Full 48 | Radial Bearing 20x52x15 Two Seals (Medium 300A Series) | 1 |
| 27 | 827.7M - 38M1-52 | SKF Metal Retaining Ring Steel Metric (Fastenal) (31162400) | 1 |
| 28 | 97063A124 | Round Shims 3/4 x 1-1/4 | 1 |
| 29 | 2250K14 | Grease Zerk (Metric Grease Fitting) M8 X 1 Male 14.9 mm | 1 |
| 30 | 7363SK6 | Metallic-Object Proximity Switch W/Male Plug 3-Wire DC, 1.5mm Range, 5/8" Wide 18mm Diameter | 1 |
| 31 | 6540K164 | Seal Double O-Ring Viton (ASS48A Dash Number 224) 1/8 x 1-3/4 x 2 | 1 |

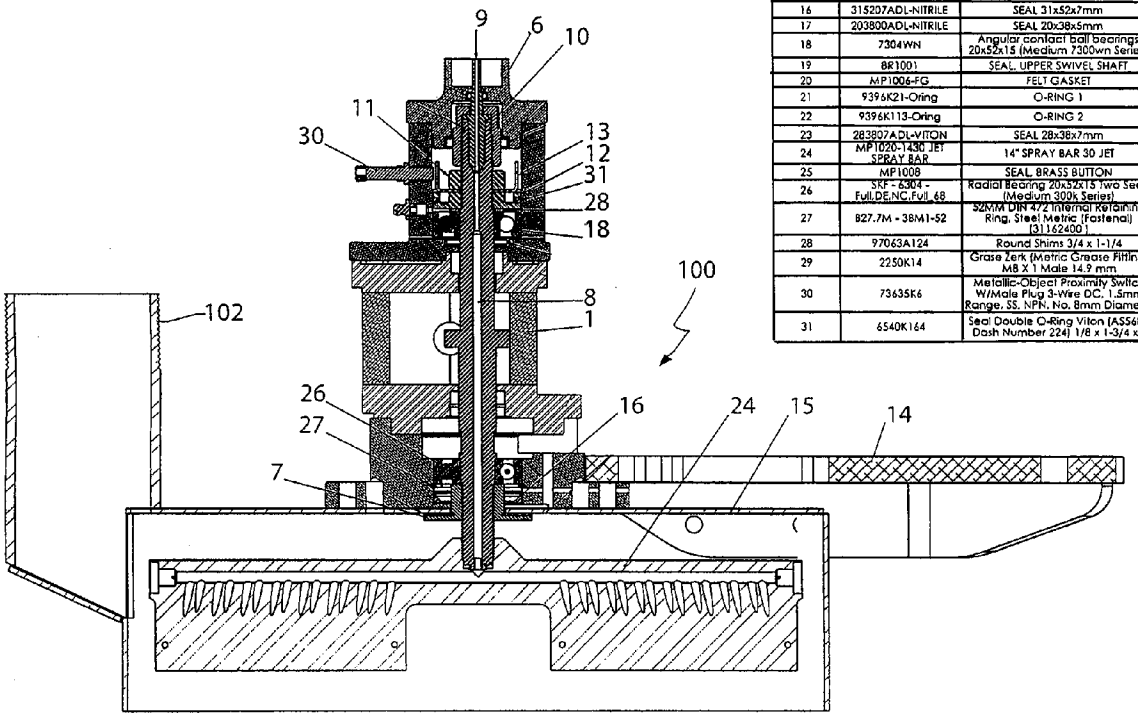

Fig. 2B

WATER BLASTING HEAD WITH THROUGH FEEDING HYDRAULIC MOTOR

RELATED APPLICATIONS

This application claims the benefit under 35 U.S.C. 119(e) of U.S. Provisional Patent Application No. 61/032,286, filed Feb. 28, 2008, entitled "WATER BLASTING HEAD WITH THROUGH FEEDING HYDRAULIC MOTOR", the entirety of which is incorporated herein by reference. This application is also related to U.S. Pat. No. 7,255,116, entitled "STRIPE REMOVAL SYSTEM"; U.S. patent application Ser. No. 11/340,738, filed Jan. 26, 2006, and entitled "TRANSPORTAL HOLDING TANK FOR STRIPE REMOVAL SYSTEM"; U.S. patent application Ser. No. 11/340,104, filed Jan. 26, 2006, entitled "MOBILE MARK REMOVAL SYSTEM"; U.S. patent application Ser. No. 11/368,020, filed Mar. 3, 2006, entitled "ARTICUABLE ARM FOR A MOBILE MARK REMOVAL SYSTEM"; U.S. patent application Ser. No. 11/368,035, filed Mar. 3, 2006, entitled "COMBINED GRINDER AND WATER BLASTER FOR STRIPE REMOVAL"; and U.S. patent application Ser. No. 11/835,642, filed Aug. 8, 2007, entitled "STRIPE REMOVAL SYSTEM".

FIELD OF THE INVENTION

This invention relates to the field of high pressure water cleaning devices for highways, runways, parking decks, factory floors and other marked surfaces. More specifically the invention is a high pressure water blasting head that includes a through feeding hydraulic motor for supplying the spray bar of the blast head with ultra high pressure water.

PRIOR ART BACKGROUND

The use of paint stripes on road surfaces is the accepted method to indicate vehicle lanes, crossing lanes, parking areas and numerous other indicators. Various pavement marking techniques are well known in the art, including the use of traffic paint, thermoplastics, epoxy paints and preformed tapes. Most pavement marking systems are intended to be as durable and permanent as possible, and resistant to weathering and wear from traffic. Common road surfaces are asphalt and concrete. The removal of such striping is typically required when the road is to be resurfaced or if the indication is to be changed.

When polymers such as paint or plastic are used for roadway marking, the surface of the pavement is penetrated from ⅛-⅜ inch, so that mere surface removal of the marking material is not sufficient to remove the marking. Therefore, current pavement marking removal machines often employ various forms of cutting devices to remove the marking material, as well as a portion of the underlying layer of pavement material in order to effectively remove painted lines.

Commonly known methods for removal of such markings typically include the use of abrasive grinding wheels, material removing cutters, or blasting of abrasive particles against the material to be removed. However, the use of these devices often results in undesirable grooves in the pavement surface.

It is also known in the art of marking removal to utilize high pressure water to remove road markings and the like. For example, U.S. Pat. No. 5,078,161 to Raghaven et al. discloses a method of cleaning an airport runway utilizing ultra high pressure water. The device disclosed by Raghaven includes a rotatably mounted spray bar. A hollow conduit extends to the spray bar through which the high pressure water is supplied to the spray bar. A hydraulic motor and belt are utilized to rotate the hollow conduit and the spray bar simultaneously. A drawback to this configuration is component failure and wasted energy. Belts or chains are prone to breakage and require additional maintenance. The use of a gear train between the motor and the conduit requires precision mounting points for alignment significantly increasing the cost of the assembly.

Therefore, what is needed in the art is a high pressure water blasting head having a hydraulic motor with a tubular output shaft. The tubular output shaft should be constructed and arranged to directly rotate at least one device, preferably a spray bar, with a first pressurized fluid while allowing the passage of a second fluid through the pump via the output shaft to supply the second fluid to the rotated device.

SUMMARY OF THE PRESENT INVENTION

Briefly, disclosed is an ultra high pressure blasting head for a mobile marking removal system. The blasting head includes a hydraulic motor that is constructed and arranged for direct connection to a spray bar for controlled rotation thereof. The output shaft of the hydraulic motor is constructed to be hollow or tubular so that the ultra high pressure water can be supplied to the spray bar through the output shaft. The spray head assembly is particularly suited for mobile systems utilized to remove markings and/or coatings from surfaces with high or ultra high pressure liquid. The mobile system generally employs a liquid reservoir connected to a high or ultra high pressure pump for directing ultra high pressure water through the output shaft of the motor to the blast head mounted on a front portion of a vehicle. A vacuum reservoir and vacuum pump are preferably utilized to recover the water and debris from the surface. The arm permits an operator to easily maintain alignment of the blast heads to the surface markings being removed. After marking removal, the arm permits the blast head(s) to be raised to a position suitable for vehicle transport.

Therefore, it is an objective of this invention to provide a blast head assembly for a mark removal system.

It is another objective of the instant invention to provide a blast head assembly wherein a rotating spray bar connects directly to the output shaft of a hydraulic motor.

It is a further objective of the instant invention to provide a hydraulic motor for a blast head assembly wherein the hydraulic motor is provided with a hollow or tubular output shaft for supplying high pressure fluid to the spray bar.

It is yet a further objective of the instant invention to provide a hydraulic motor with a hollow or tubular output shaft for supplying a secondary fluid to the device or assembly being rotated by the motor.

It is still another objective of the instant invention to provide a blast head assembly having a spray bar rotatable by a hydraulic motor with a tubular output shaft so that high pressure water can be supplied to the spray bar through the output shaft of the hydraulic motor.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

FIG. 2B is section view of one embodiment of the instant invention;

DETAILED DESCRIPTION OF THE INVENTION

Referring generally to FIGS. 1-4, a blast head 100 for use in removing markings from a marked surface is illustrated. The blast head 100 is constructed and arranged to be connected to a mobile vehicle, preferably at the front portion thereof at the distal end of a articulable arm (not shown) where it can be infinitely maneuvered to extend across the front portion and beyond the sides of the vehicle if desired. A joystick or other suitable control device (not shown) is provided in the mobile vehicle to allow an operator to manipulate the articulable arm about various axes for an operator determined path of the blast head(s). The mobile marking removal vehicle is preferably a truck however, tractors, heavy equipment and the like may be utilized without departing from the scope of the invention.

Figure 1:
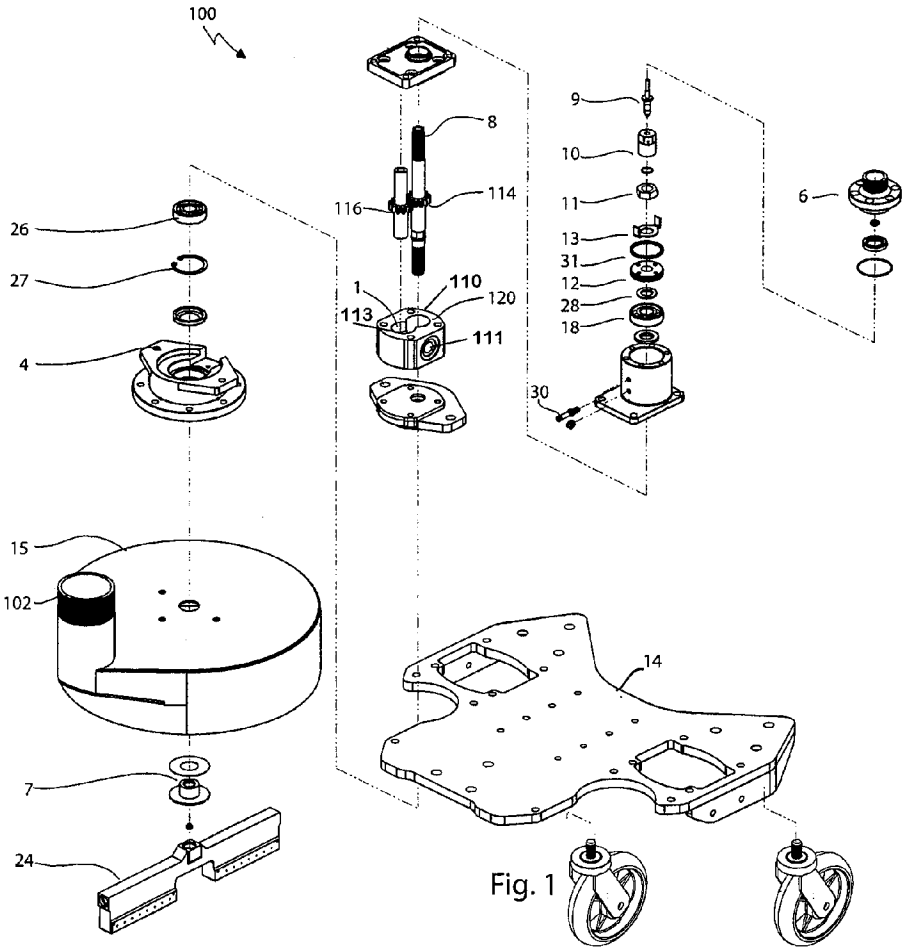
FIG. 1 is an exploded perspective views of one embodiment of the instant invention.
Figure 2A:
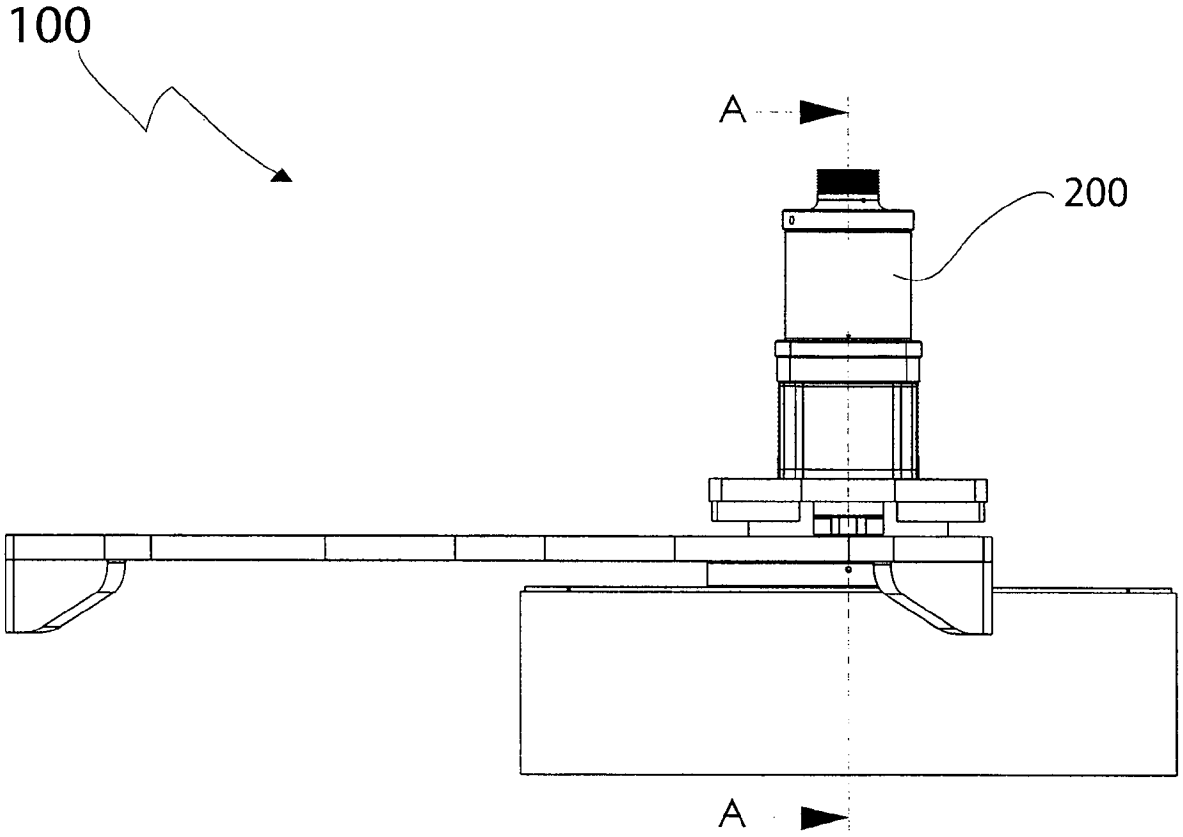
FIG. 2A is side view of one embodiment of the blast head of the instant invention illustrated with a caster plate for mounting one or two blast heads.
Figure 2C:
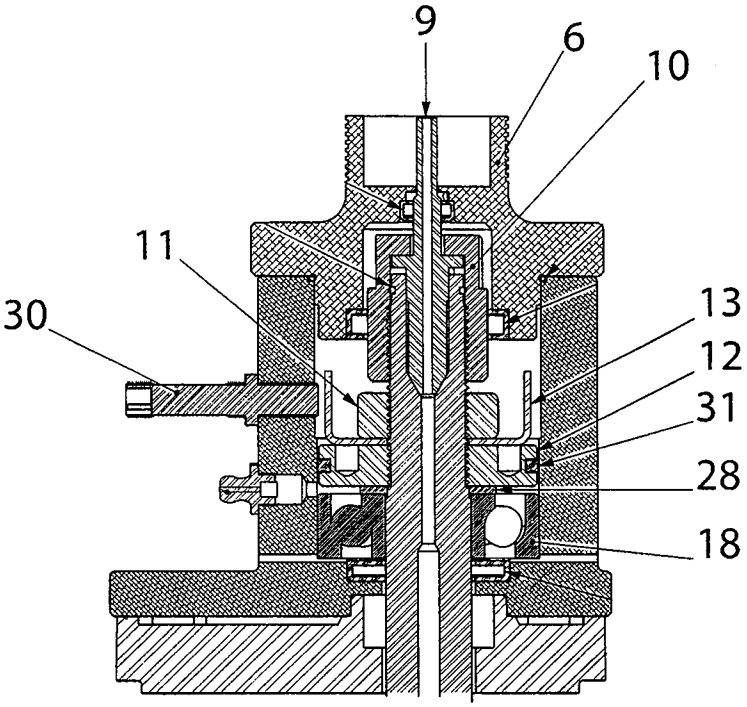
FIG. 2C is a partial section view illustrating the thrust assembly portion of the hydraulic motor assembly.
Figure 3:
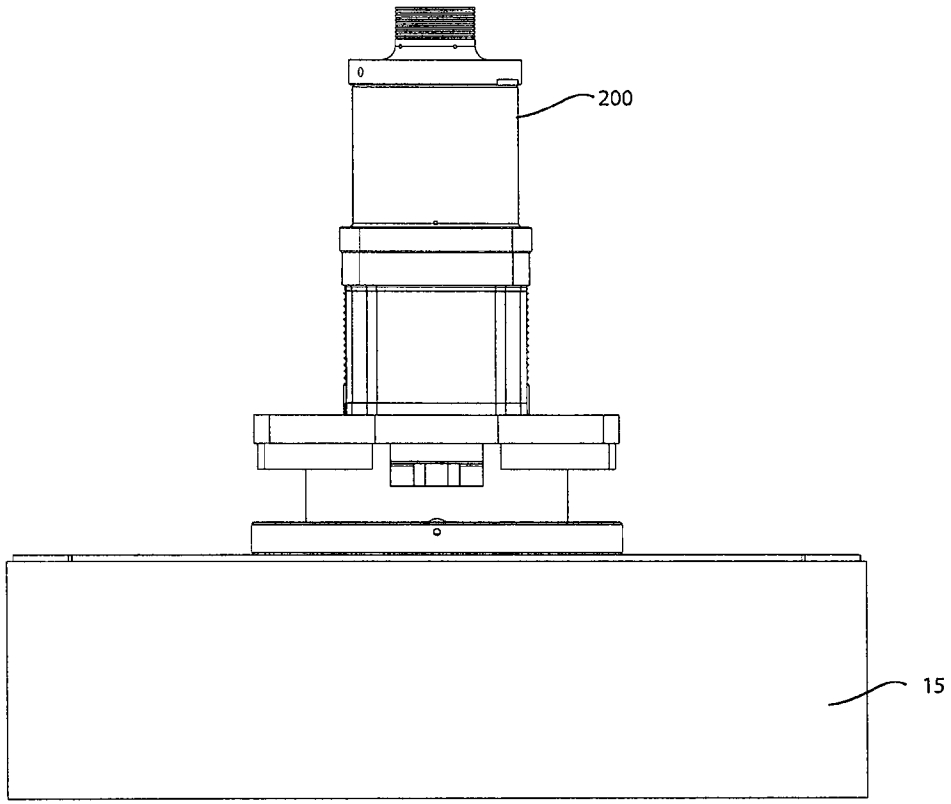
FIG. 3 is a front view illustrating one embodiment of the instant invention.
Figure 4:
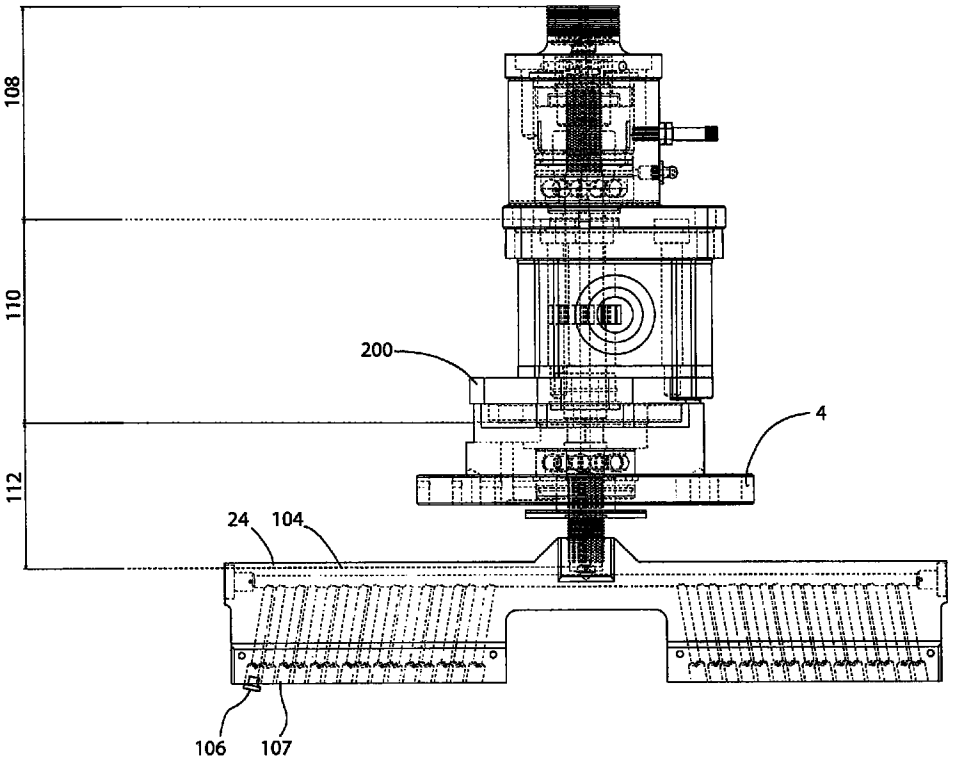
FIG. 4 is a partial side view illustrating one embodiment of the instant invention.
Figure 8:
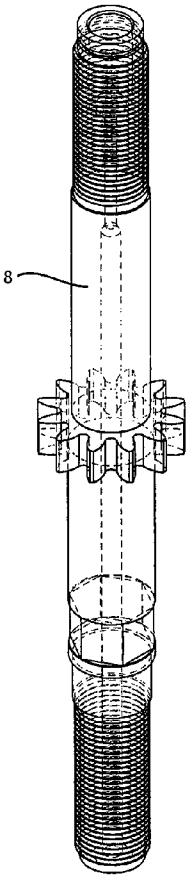
FIG. 8 is a perspective view of one embodiment of the hydraulic motor output shaft.
Figure 7:
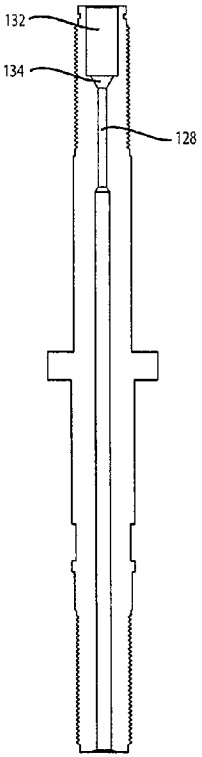
FIG. 7 is a section view of the output shaft embodiment illustrated in FIGS. 5 and 6.
Figure 6:
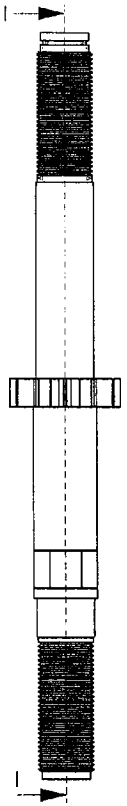
FIG. 6 is a side view of one embodiment of the instant invention illustrated without the actuators for clarity.
Figure 5B:
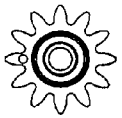
FIG. 5B is an end view of one embodiment of the hydraulic motor output shaft.
Figure 5A:
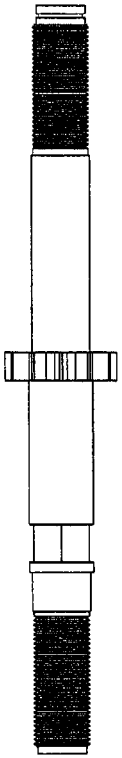
FIG. 5A is a front view of one embodiment of the hydraulic motor output shaft.
Figure 13:
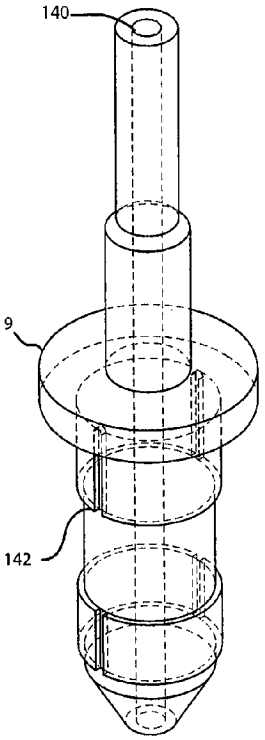
FIG. 13 is a perspective view of one embodiment of the swivel inlet of the instant invention.
Figure 12:
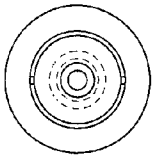
FIG. 12 is an end view of one embodiment of the swivel inlet of the instant invention.
Figure 11:
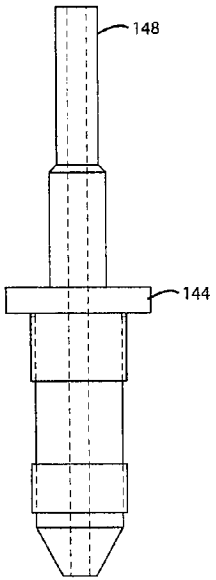
FIG. 11 is a side view of one embodiment of the swivel inlet of the instant invention.
Figure 10:
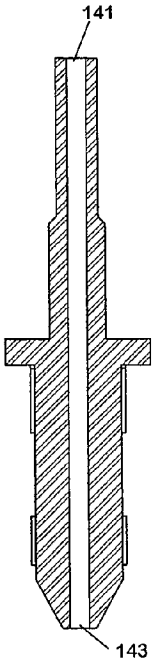
FIG. 10 is a section view of one embodiment of the swivel inlet of the instant invention.
Figure 9B:
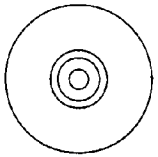
FIG. 9B is an end view of one embodiment of the swivel inlet of the instant invention.
Figure 9A:
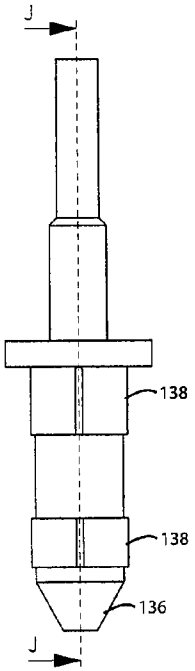
FIG. 9A is a front view of one embodiment of the swivel inlet of the instant invention.
Figure 14:
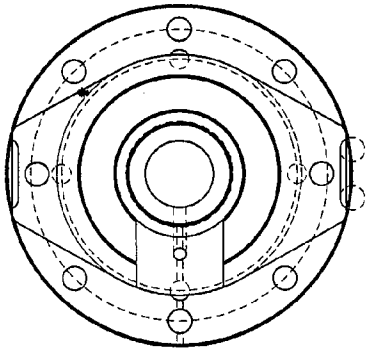
FIG. 14 is a top view of one embodiment of the flange adapter of the instant invention.
Figure 15:
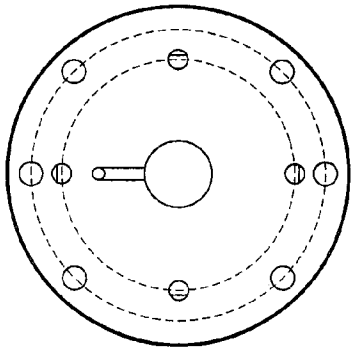
FIG. 15 is a bottom view of one embodiment of the flange adapter of the instant invention.
Figure 16:
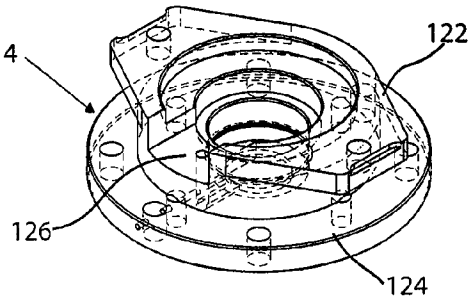
FIG. 16 is a perspective view of one embodiment of the flange adapter of the instant invention.
Figure 17:
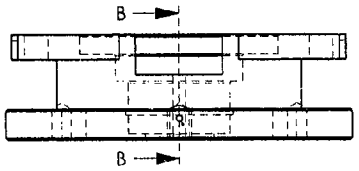
FIG. 17 is a front view of one embodiment of the flange adapter of the instant invention.
Figure 18:
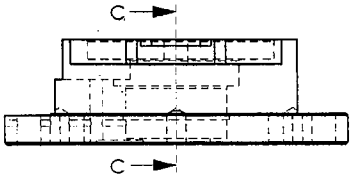
FIG. 18 is a right side view of one embodiment of the flange adapter of the instant invention.
Figure 19:
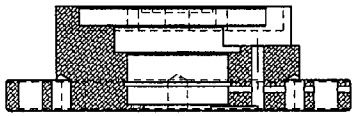
FIG. 19 is a section view of one embodiment of the flange adapter of the instant invention taken along lines B-B of FIG. 17.
Figure 20:
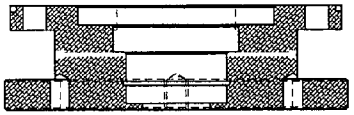
FIG. 20 is a section view of one embodiment of the flange adapter of the instant invention taken along lines C-C of FIG. 18.
Figure 21:
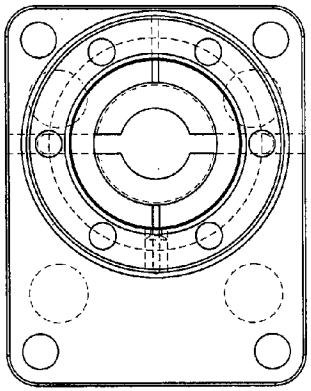
FIG. 21 is a top view of one embodiment of the thrust housing of the instant invention.
Figure 28:
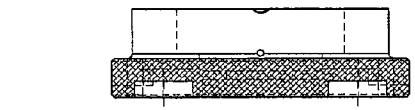
FIG. 28 is a section view of one embodiment of the thrust housing taken along lines N-N of FIG. 25.
Figure 24:
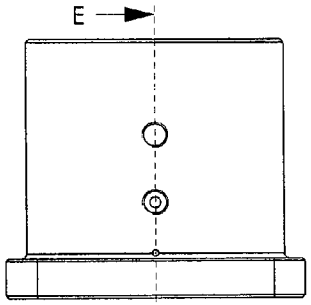
FIG. 24 is a front view of one embodiment of the thrust housing of the instant invention.
Figure 25:
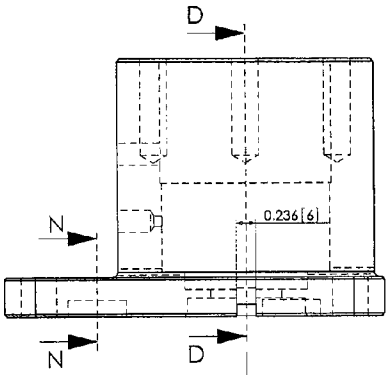
FIG. 25 is a right side view of one embodiment of the thrust housing of the instant invention.
Figure 22:
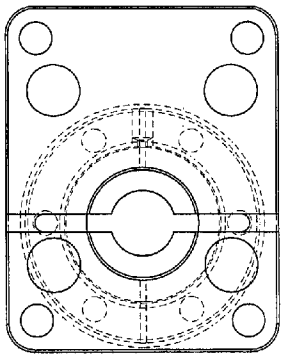
FIG. 22 is a bottom view of one embodiment of the thrust housing of the instant invention.
Figure 23:
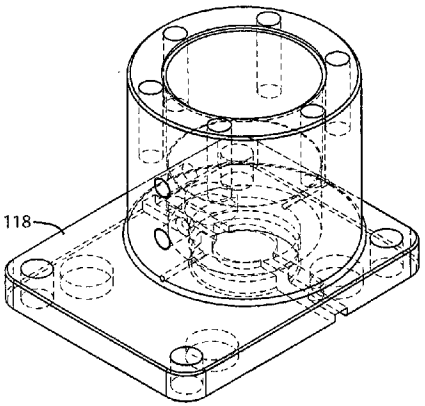
FIG. 23 is a perspective view of one embodiment of the thrust housing of the instant invention.
Figure 26:
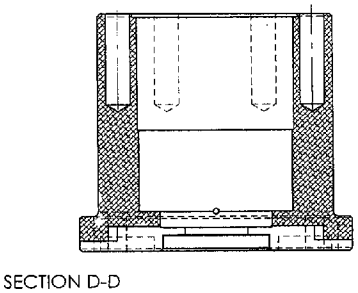
FIG. 26 is a section view of one embodiment of the thrust housing taken along lines D-D of FIG. 25.
Figure 27:
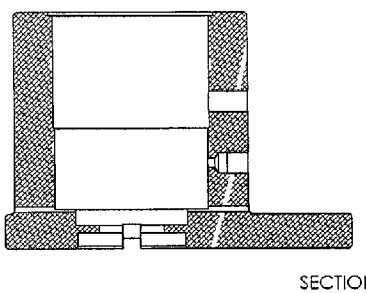
FIG. 27 is a section view of one embodiment of the thrust housing taken along lines E-E of FIG. 24.
Figure 35:
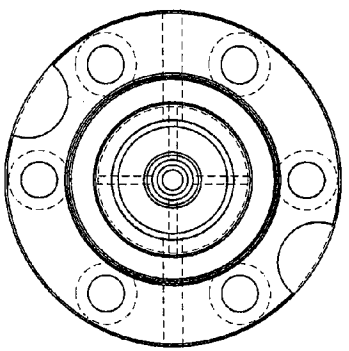
FIG. 35 is a bottom view of the housing thrust cover of the instant invention.
Figure 32:
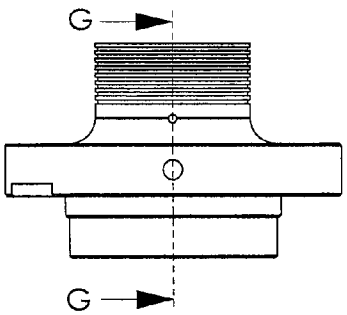
FIG. 32 is a right side view of the housing thrust cover of the instant invention.
Figure 29:
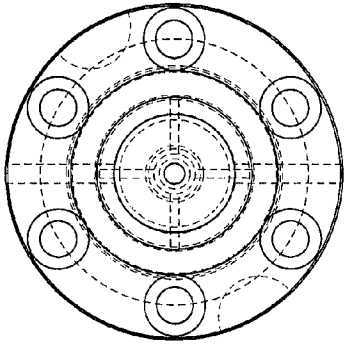
FIG. 29 is a top view of the housing thrust cover of the instant invention.
Figure 31:
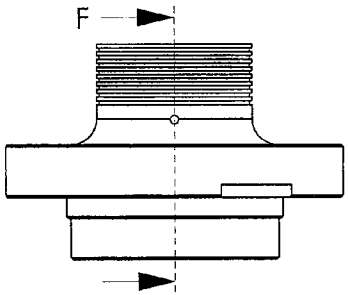
FIG. 31 is a front view of the housing thrust cover of the instant invention.
Figure 30:
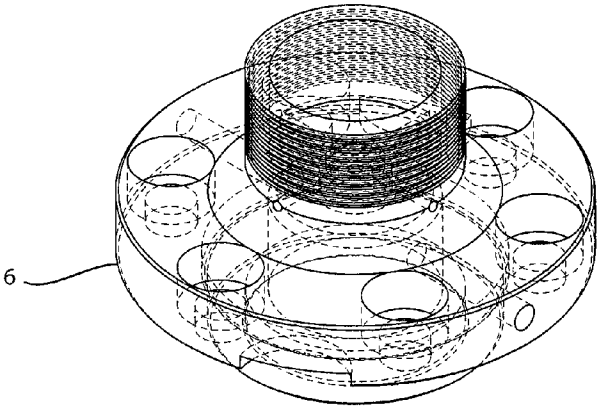
FIG. 30 is a perspective view of the housing thrust cover of the instant invention.
Figure 34:
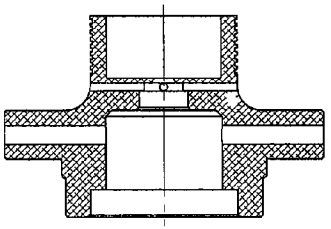
FIG. 34 is a section view of the housing thrust cover of the instant invention taken along lines F-F of FIG. 31.
Figure 33:
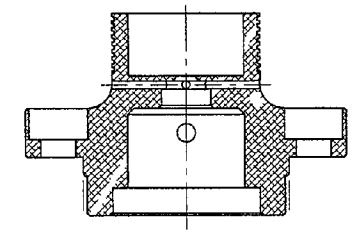
FIG. 33 is a section view of the housing thrust cover of the instant invention taken along lines G-G of FIG. 32.
Figure 37:
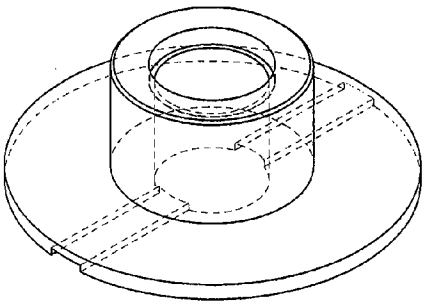
FIG. 37 is a perspective view of the dirt shield of the instant invention.
Figure 36:
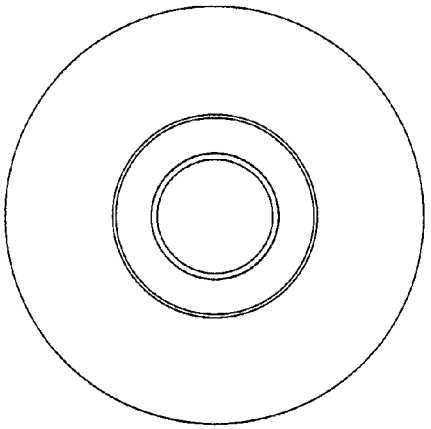
FIG. 36 is a top view of the dirt shield of the instant invention.
Figure 40:
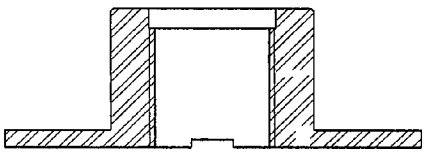
FIG. 40 is a section view of the dirt shield of the instant invention taken along lines H-H of FIG. 39.
Figure 39:
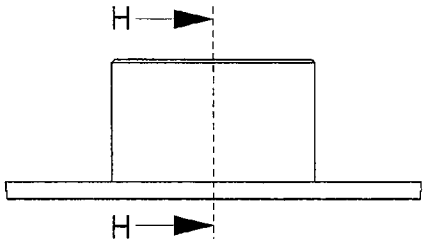
FIG. 39 is a right side view of the dirt shield of the instant invention.
Figure 38:
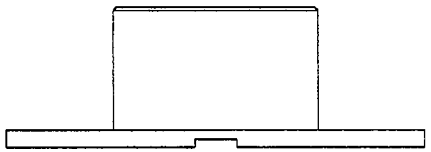
FIG. 38 is a front view of the dirt shield of the instant invention.
Figure 41:
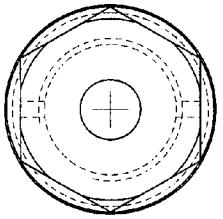
FIG. 41 is a top view of the gland nut of the instant invention.
Figure 42:
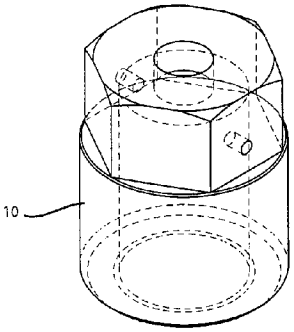
FIG. 42 is a perspective view of the gland nut of the instant invention.
Figure 43:
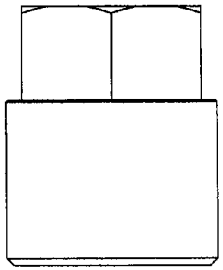
FIG. 43 is a front view of the gland nut of the instant invention.
Figure 44:
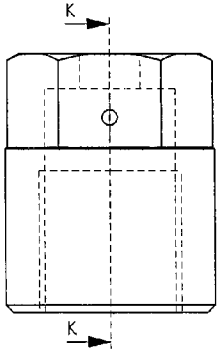
FIG. 44 is a right side view of the gland nut of the instant invention.
Figure 45:
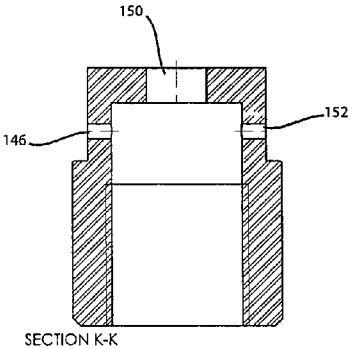
FIG. 45 is a section view of the gland nut of the instant invention taken along lines K-K of FIG. 44.
Figure 46:
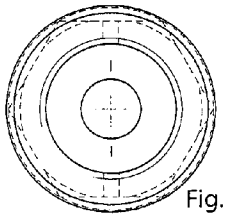
FIG. 46 is a bottom view of the gland nut of the instant invention.
Figure 48:
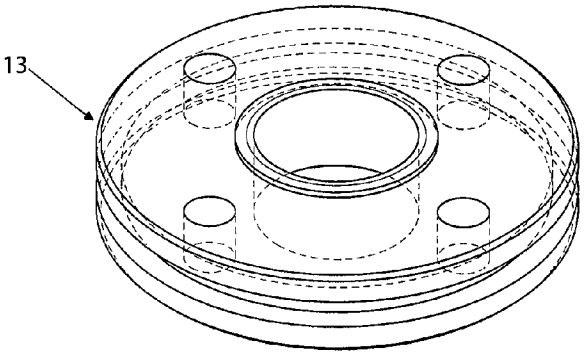
FIG. 48 is a perspective view of the grease seal nut of the instant invention.
Figure 50:
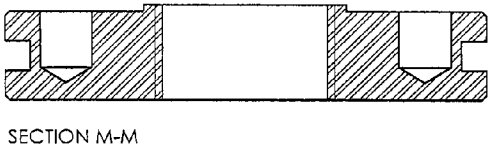
FIG. 50 is a section view of the grease seal nut of the instant invention taken along lines M-M of FIG. 49.
Figure 47:
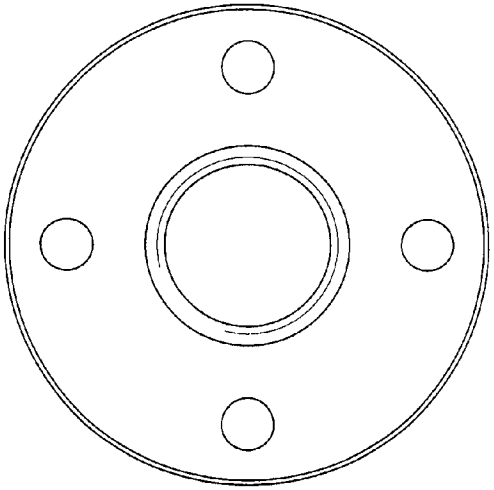
FIG. 47 is a top view of the grease seal nut of the instant invention.
Figure 49:
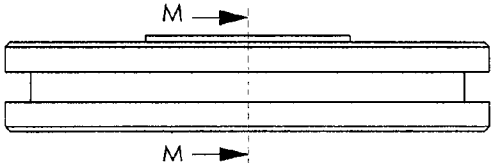
FIG. 49 is a front view of the grease seal nut of the instant invention.
Figure 52:
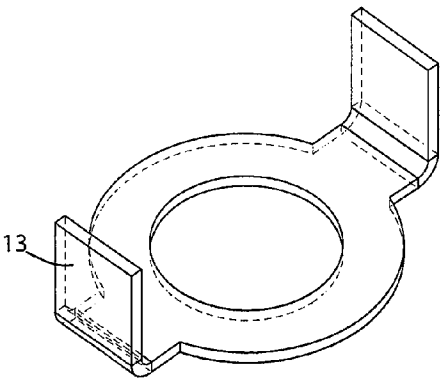
FIG. 52 is a perspective view of the counter washer of the instant invention.
Figure 51:
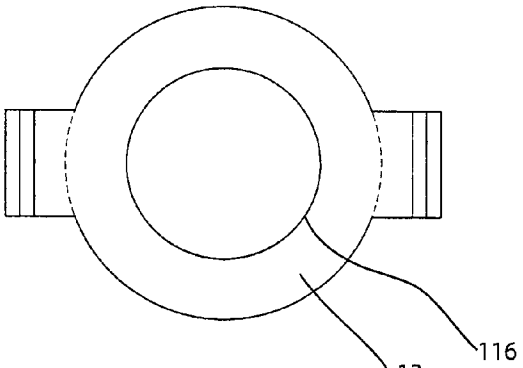
FIG. 51 is a top view of the counter washer of the instant invention.
Figure 54:
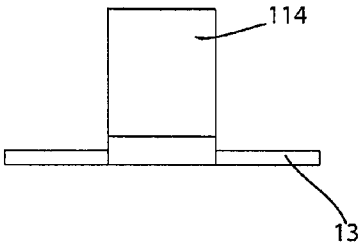
FIG. 54 is a side view of the counter washer of the instant invention.
Figure 53:
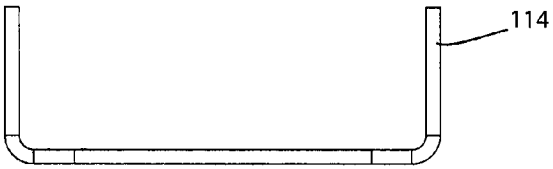
FIG. 53 is a front view of the counter washer of the instant invention.

In general the blast head 100 includes a mobile support structure in the form of a caster plate 14. The caster plate is preferably constructed of a lightweight metal such as aluminum and includes a plurality of caster wheels for supporting the blast head at a predetermined distance from the surface being cleaned. A hydraulic motor assembly 200 is secured to an upper or lower surface of the caster plate for imparting selective rotation to a spray bar 24. The hydraulic motor is provided with a hollow output shaft 8 for transfer of ultra high pressure water (e.g. 25,000-40,000 psi) through the pump to the spray bar 24. In the preferred embodiment, the spray bar 24 is directly connected to the output shaft and includes an internal flow path 104 for the ultra high pressure water, a plurality of nozzle apertures 107 and a plurality of nozzles 106. (FIG. 4). Each of the nozzles having apertures therein for expelling the ultra high pressure water against a surface. In a most preferred embodiment the nozzle apertures are between 0.005 and 0.075 inches in diameter and a single spray bar may include nozzles with various diameter apertures. A shroud 15 is also secured to a bottom surface of the caster plate, preferably in contact with an adapter flange portion 4 of the hydraulic motor assembly 200 to enclose the spray bar assembly 24 for containment of debris and water deflected from the cleaned surface. The shroud 15 may also be provided with a vacuum aperture 102 for connection to a vacuum tank for collection of the debris and used water. It should be noted that multiple blast heads may be secured to the caster plate to create various arrays of blast heads for cleaning surfaces.

FIG. 4 illustrates a partial view of the blast head 100 having the shroud 15 and caster plate 14 removed. The hydraulic motor assembly 200 of the instant invention includes a thrust assembly portion 108, a motor block portion 110, and a flange adapter portion 112. The thrust assembly portion 108 is constructed and arranged to control the vertical thrust caused by expelling the ultra high pressure water out of the nozzles and against a surface. (FIGS. 21-28). The thrust assembly includes a body portion 118, at least one bearing 18 and at least one thrust washer 28. Positioned juxtaposed to the thrust washer is a grease seal 12 threadably connected to the output shaft 8. The grease seal preferably includes at least one O-ring 31 or other suitable seal for retaining grease in the area of the bearing 18 and the thrust washer 28. Also contained within the thrust assembly body 118 is the counter washer 13. (FIGS. 51-54). The counter washer includes at least one and preferably two upstanding wall portions 114 and a centrally located aperture 116. The central aperture is sized to cooperate with the output shaft for rotation therewith, while the upstanding wall portions cooperate with a proximity switch 30 for counting revolutions of the output shaft 8. Secured to an upper portion of the thrust assembly body 118 is the thrust assembly cover 6. The thrust assembly cover 6 is constructed and arranged to cooperate with the gland nut 10 which maintains position and prevents thrust separation between the output shaft swivel 9 and the output shaft 8. Preferably a seal is provided between the gland nut 10 and the thrust assembly cover 6. A second seal is also provided between the swivel and the thrust assembly cover to prevent dirt and the like from entering the thrust assembly 108.

Referring to FIGS. 1-4, the motor block portion 110 is generally constructed and arranged to rotate the output shaft when pressurized hydraulic fluid is directed thereto through first fluid inlet 111 exiting the motor block portion 110 through the first fluid outlet 113. The motor body 1 includes a cavity 120 sized and shaped for containing a driving surface that is subject to a pressure differential to cause rotation. In a most preferred embodiment, the motor block portion includes a gear arrangement as is typically utilized in external gear pumps and motors having a driving gear 114 and an idler gear 116. The driving surface, e.g. gear, may be integrally formed to the output shaft or alternatively may be keyed clamped or otherwise secured thereto. It should also be noted that other types of motor configurations suitable for rotating the spray bar which could incorporate a hollow output shaft could be utilized without departing from the scope of the invention. Such motors may include, but should not be limited to positive displacement motors such as, direct drive gerotor, Orbiting gerotor, roller vane gerotor and the like.

The flange adapter portion 4 is constructed and arranged to provide horizontal and vertical thrust support while also providing a mounting surface for securing the motor to the shroud 15 and/or caster plate 14. The flange adapter includes at least bearing 26 secured in place with press fit and/or a retaining ring 27. The bearing is sized to accept and support the outer diameter of the output shaft 8. An upper flange 122 is provided for securing the flange adapter 4 to the motor assembly 200 while a lower flange 124 is provided to secure the motor assembly to the shroud and/or caster plate 14. The flange adapter may also include weep holes 126 and the like well known in the art for allowing water to escape from the flange prior to entering the motor assembly.

Referring to FIGS. 5-16, the output shaft 8 and swivel nozzle 9 are illustrated. The output shaft is preferably constructed from a durable material such as steel to include a hollow or tubular central bore 128. As disclosed above the purpose of the central bore is to allow the passage of high or ultra high pressure liquid (water) to pass through the output shaft to the spray bar 24. The ends of the output shaft are preferably provided with threads for securement to the thrust assembly as well as the spray bar. It should be noted that other means of securing the spray bar to the output shaft and the thrust assembly may be utilized without departing from the scope of the invention. Such means of securing may include, but should not be limited to, locking tapers, snap rings, spring pins, clamps, suitable combinations thereof, and the like. The swivel 9 includes a swivel inlet 141 for connection to the high pressure liquid and a swivel outlet 143. The upper portion 130 of the output shaft 8 includes a cavity 132 for accepting the swivel 9. The bottom of the cavity 132 preferably includes a tapered seat 134 which cooperates with a tapered end 136 of the swivel including swivel outlet 143. In a most preferred embodiment, the clearance between the side wall bearing surfaces 138 of the swivel is such that the ultra high pressure water passing between the swivel aperture 140 and the output shaft bore 128 provides lubrication between the two components without allowing substantial leakage. The bearing surfaces may also include grooves 142 which further allow the water to provide lubricity. A flange 144 is also provided on the swivel to cooperate with an inner surface 146 of the gland nut 10. An upper tip portion 148 of the swivel extends through aperture 150 of the gland nut for connection to the high or ultra high pressure water pump (not shown). The gland nut 10 may also be provided with weep holes 152 to allow the escapement of excess water.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A cleaning device for discharging fluid under high pressure towards a surface to remove coatings therefrom comprising:

a blast head, said blast head having at least one nozzle constructed and arranged to deliver a second high pressure fluid toward a surface;

said blast head having a shroud, said shroud having a top, sides and an open bottom, said top of said shroud being connected to a flange adapter portion of a hydraulic motor, said hydraulic motor mounted on said shroud to provide horizontal and vertical thrust support to said shroud, said hydraulic motor having a first fluid input and a first fluid output for causing rotation of a tubular spindle within said hydraulic motor, said tubular spindle having a driving surface on an outer surface of said tubular spindle to cause rotation thereof in response to a pressure differential provided by said driving surface cooperating with a first pressurized fluid, said driving surface being a gear surface, said gear surface intermeshing and causing rotation of an idler gear in response to rotation of said gear surface, said spindle being tubular including a conduit passing through said hydraulic motor, said tubular spindle having a spindle inlet positioned on a first side of said hydraulic motor and a spindle outlet positioned on a second side of said hydraulic motor for passage of a second pressurized fluid through said tubular spindle;

a swivel inlet fluidly connected to said second pressurized fluid for delivery of said second high pressure fluid to a swivel outlet, said swivel outlet fluidly connected to said spindle inlet, said spindle outlet being in fluid communication with said at least one nozzle;

whereby said second high pressure fluid passes through said tubular spindle to said at least one nozzle for impingement against a surface to be cleaned.

2. The cleaning device of claim 1 including a spray bar in fluid communication with said swivel outlet;

a plurality of said nozzles mounted on said spray bar and in fluid communication therewith, whereby rotation of said spindle causes rotation of said spray bar and said plurality of nozzles deliver said second pressurized fluid to a surface to remove coatings thereon.

3. The cleaning device of claim 2 wherein said spray bar extends within said shroud from adjacent one side of said shroud to adjacent another side of said shroud.

4. The cleaning device of claim 1 including a plurality of wheels connected to and supporting said blast head a predetermined distance from the surface.

5. The cleaning device of claim 1 wherein said second high pressure fluid in between substantially 25,000 and 40,000 pounds per square inch.

6. The cleaning device of claim 1 wherein said second high pressure fluid is water.

7. The cleaning device of claim 1 including at least one pair of bushing seals mounted on said blast head, said at least one pair of bushing seals being located both above and below said hydraulic motor.

8. The cleaning device of claim 7 wherein said bushing seals are thrust bearings.

9. The cleaning device of claim 1 wherein said driving surface is a multi-toothed gear mounted around said spindle, said multi-toothed gear having multiple said gear surfaces for driving said tubular spindle.

* * * * *